US006131222A

United States Patent [19]

Anderson et al.

[11] Patent Number: 6,131,222

[45] Date of Patent: Oct. 17, 2000

[54] TROWEL AND SCREWDRIVER COMBINATION HANDTOOL

[76] Inventors: Wayne Anderson, 65 Grove St.; Paolo Cassutti, 8 N. Creek Rd., both of Northport, N.Y. 11768

[21] Appl. No.: 09/436,894

[22] Filed: Nov. 9, 1999

Related U.S. Application Data

[63] Continuation of application No. 09/134,684, Aug. 14, 1998, and a continuation-in-part of application No. 09/237,784, Jan. 26, 1999, which is a continuation of application No. 08/977,027, Nov. 24, 1997, Pat. No. 5,927,164, which is a continuation of application No. 08/451,398, May 26, 1995, Pat. No. 5,711,194.

[51] Int. Cl.[7] ..... B44C 7/00

[52] U.S. Cl. ..... 7/105; 7/167; 7/118; 7/128

[58] Field of Search ..... 7/105, 118, 128, 7/165, 167

[56] References Cited

U.S. PATENT DOCUMENTS

| | | | |
|---|---|---|---|
| 4,512,693 | 4/1985 | Swanson | 7/165 |
| 5,063,627 | 11/1991 | Marra | 7/105 |
| 5,251,352 | 10/1993 | Cullison | 7/105 |
| 5,515,249 | 5/1996 | Shiao | 7/165 |
| 5,711,194 | 1/1998 | Anderson et al. | 7/118 |
| 5,720,063 | 2/1998 | Chacon | 7/105 |
| 5,870,786 | 2/1999 | Papadopoulos | 7/105 |
| 5,927,164 | 7/1999 | Anderson et al. | 7/118 |
| 5,956,788 | 9/1999 | Henke | 7/105 |

*Primary Examiner*—David A. Scherbel
*Assistant Examiner*—Lee Wilson
*Attorney, Agent, or Firm*—Lackenbach Siegel Marzullo Aronson & Greenspan, P.C.

[57] ABSTRACT

A combination trowel and screwdriver is provided wherein the trowel handle houses and removably retains a tool bit drive assembly which houses a plurality of tool bit or screw drives. The user pivots the tool bit drive assembly housing away from the handle to a position extending in the proximate direction from the handle. The user then selects the desired tool bit drive for insertion at the proximate end of the assembly and with the proximate end of the handle screws the screw into a recessed position in a wallboard construction. The user then retracts or repivots the tool bit drive assembly into the handle, and then with the trowel end putties or spreads a wallboard plastic or finishing material over the recessed screw head to finish the wall.

15 Claims, 3 Drawing Sheets

TROWEL AND SCREWDRIVER COMBINATION HANDTOOL

This application is a continuation of Ser. No. 09/134,684, filed Aug. 14, 1998 and is a continuation-in-part of Ser. No. 09/237,784, filed Jan. 26, 1999 which is a continuation of Ser. No. 08/977,027, filed Nov. 24, 1997, now U.S. Pat. No. 5,927,164, issued Jul. 27, 1999, which is a continuation of Ser. No. 08/451,398, filed May 26, 1995, now U.S. Pat. No. 5,711,194, issued Jan. 27, 1998.

FIELD OF THE INVENTION

This invention relates to hand tools. Specifically this invention relates to a combination hand tool having both a trowel and a tool bit drive.

BACKGROUND OF THE INVENTION

Wallboard construction requires the use of a screwdriver or a plurality screwdrivers to counter-sink screws in mounting the wallboard, and then the use of a trowel or putty knife to spread wallboard finishing plastic composition over the screw head and at the wallboard joints to provide a smooth even wall surface finish.

The construction worker in prior art practice had to carry and alternately use a screwdriver or screwdrivers of diverse size, and then a trowel. This need to carry and alternately use this plurality of hand tools made the job cumbersome and time consuming.

The art desired a combination hand tool which provided both a plurality of screwdriver tool bit drive functions and trowel functions, and yet be of practical design, and safe and practical use. It was also desired that the hand tool in achieving these functions permit rapid alternate use to thereby reduce the time required to do alternate wallboard construction and finishing functions.

SUMMARY OF THE INVENTION

The invention in a broad aspect is a hand tool having the construction and operable combination of a trowel and a tool bit drive.

The invention in another aspect is a three component hand tool namely (1) a handle having a proximate end and a distal end, (2) a wide flexible metal blade or trowel attached to the distal end of the handle, and (3) a tool bit drive housing assembly having a tool bit drive such as a screwdriver attached to and selectively extending from the proximate end of the handle. The screwdriver assembly is pivotally mounted to first position where it extends in the proximate direction away from the handle and to a second position where the screwdriver assembly is received in a recess formed in the handle. In the first position, the user grips the handle and operates the tool as a screwdriver, and in the second portion the user reverses the handle grip and uses the tool as a trowel.

The tool bit drive housing is of unitary construction, and houses and provides for alternate use of a plurality of tool bit, such as differently sized Phillips or slotted head screwdriver bits. The trowel is removably attached at and to the distal end of the handle, and diverse trowels, putty knives and the like can selectively be attached to the distal end of the handle.

DESCRIPTION OF THE INVENTION

Figure 2:
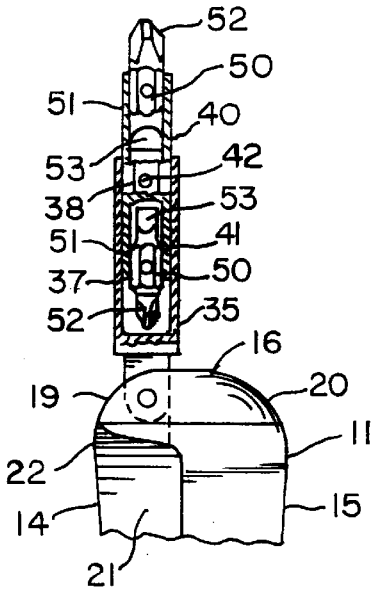
FIG. 2 is partial sectional fragmentary elevational view of the tool of FIG. 1 showing the tool bit drive assembly in its extended proximate direction position.
Figure 1:
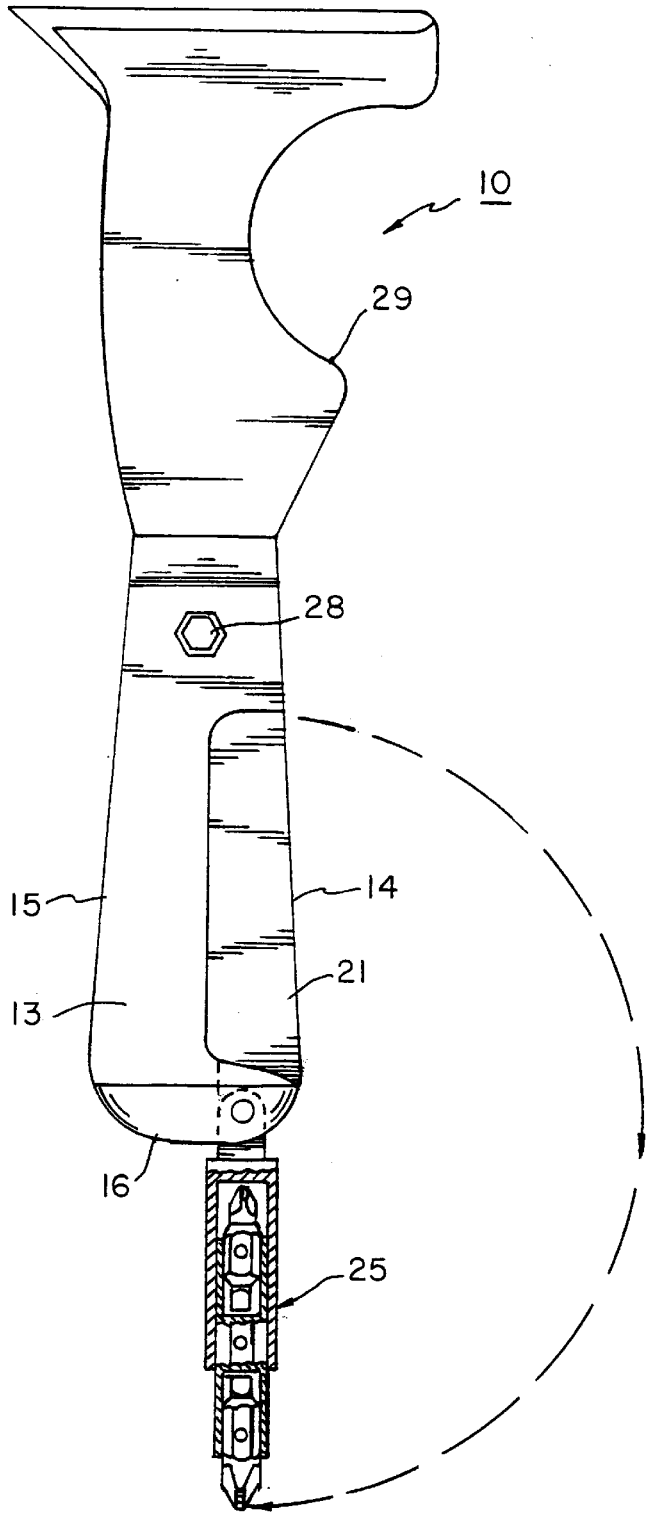
FIG. 1 is a partial development elevational view of the combination hand tool of the present invention.
Figure 4:
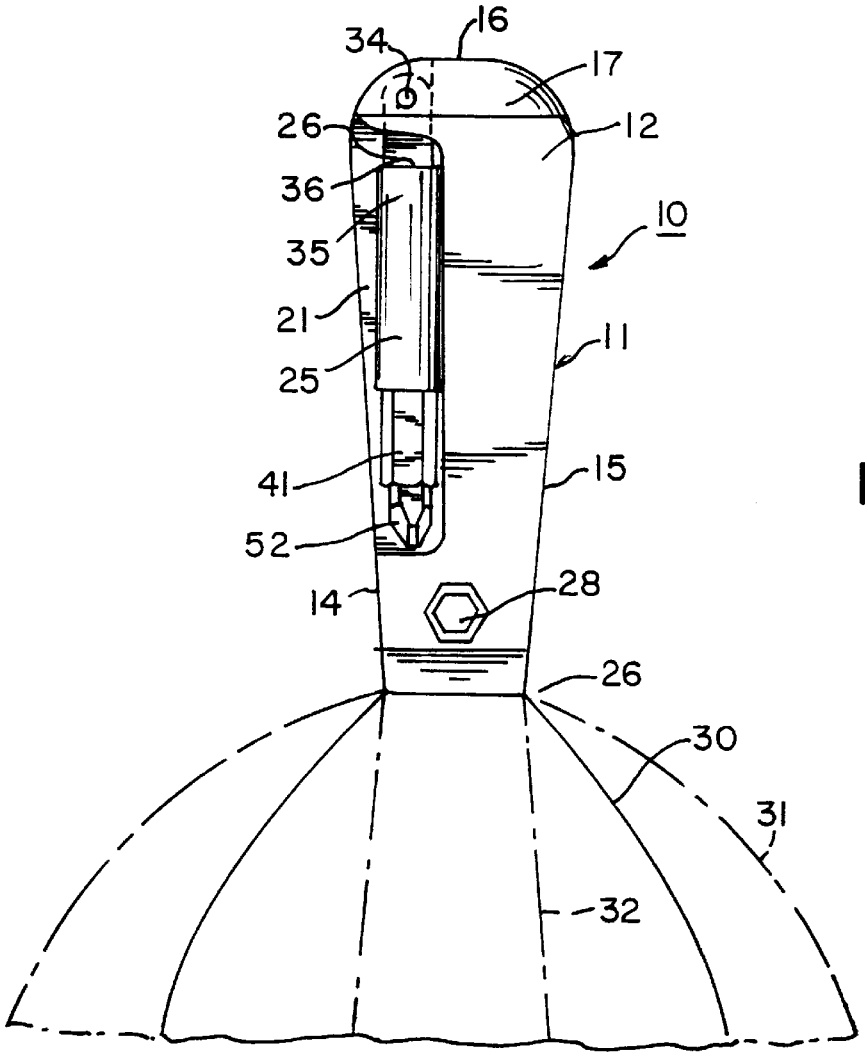
FIG. 4 is a left side view of the tool of and as shown in FIG. 3.
Figure 3:
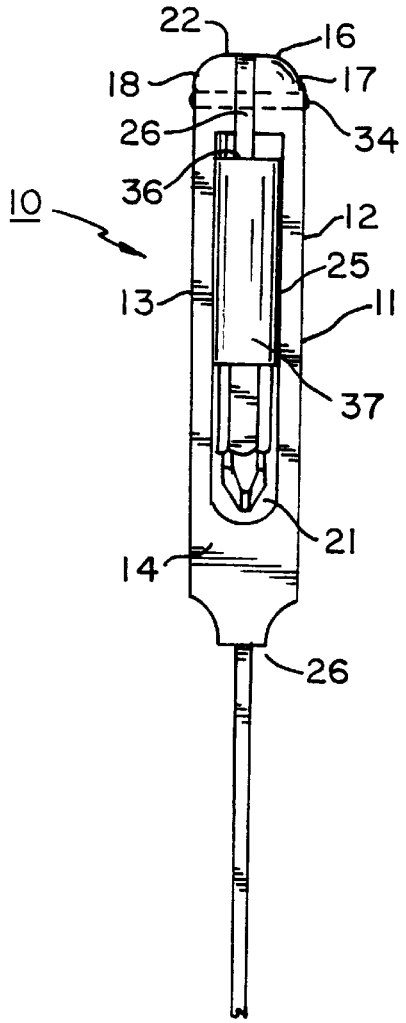
FIG. 3 is a fragmentary elevational view of the tool as shown in FIG. 2, but showing the tool bit drive assembly in the retracted position within the handle, and also showing alternate differently sized and shaped trowels attachable at the distal end.

Referring to the FIGS. 1–4, there is shown the combination hand tool 10. Hand tool 10 has a handle 11 having oppositely disposed sides 12 and 13 and oppositely disposed ends 14 and 15. Handle 11 formed with a proximate flat end 16 and rounded proximate end walls 17 and 18 adjoining respective sides 12 and 13 and rounded proximate end walls 19 and 20 adjoining respective ends 14 and 15. The handle 11 may be of conventional wood or molded plastic construction.

Handle 11 is formed with a cut-out portion or recess 21 formed in handle end 14 and contiguous handle side 12, with contiguous slot 22 extending to proximate flat end 16. Recess 21 is sized for housing and slidably pivotally receiving tool bit drive assembly 25. as will be more fully explained hereinafter.

Handle 11 is formed at its distal end 26 with a receiving slot (not shown) formed in handle ends 14 and 15 of sides 12 and 13, which are tapered in the direction of distal end 26. Handle 11 is also formed with a through hole (not shown) extending through sides 12 and 13. A conventional attachment member or grommet 28, sidably fits through the hole for detachably attaching a trowel, scraper, putty knife or like plastic or spreadable composition working or scraping element or blade, e.g. blades 29, 30, 31 and 32. The blades (29–32) are preferably of flexible metal construction as is well known in the art.

Tool bit drive assembly 25 is formed with a flange 26 which is slidably rotatably received in handle slot 22 and mounted on pivot pin 34 to handle 11. Assembly housing 35 is formed with or attached to end 36 of flange 26 and is sized to be slidably received in handle recess 21, and when so received, handle 11 is without any protuberances. Assembly housing 35 is formed with an cylindrial outer surface 37 and a hexagonal inner surface on cavity 38. A tool bit drive housing 40 is formed with a hexagonal outer surface 41 and partial spherical detent 42. Tool bit drive housing 40 is sized to be slidably releasably received in assembly housing 35 inner cavity 38 and retained therein by detent 42 in spherical recess (not shown) formed in the wall forming cavity 38. Tool bit drive housing 40 is of cold heading unitary construction and formed with oppositely disposed hexagonal inner cavities 45. Two tool bit drive members 50 are each formed with a hexagonal coupling body portion 51 and tool bit drives 52 and 53 (typical) formed with and oppositely disposed, extending away from body portion 51. Member body portions 51 are sized to be received and housed in inner cavities 45.

Tool bit drives 52 are Phillips head screw drives, while tool bit drives 53 are slotted head screw drives. The tool bit drives 52 and 53 may be differently sized. This provides the user with a selection of four different tool bit drives, which may be of the same type but differently sized or may have different screw head drive functions. The user may selectively assemble whichever tool bit drive and trowel element for any particularly wall construction job. With the designated tool bit drive and trowel element assembled in and to the handle, the user does the wall construction with this one hand tool, eliminating the need to replace tools for alternate screwdriver and wall finishing functions.

It is also to be noted that the inner hexagonal housing and assembly surfaces are hexagonal and provide the hand tool a nut drive functions as well.

Figure 5:
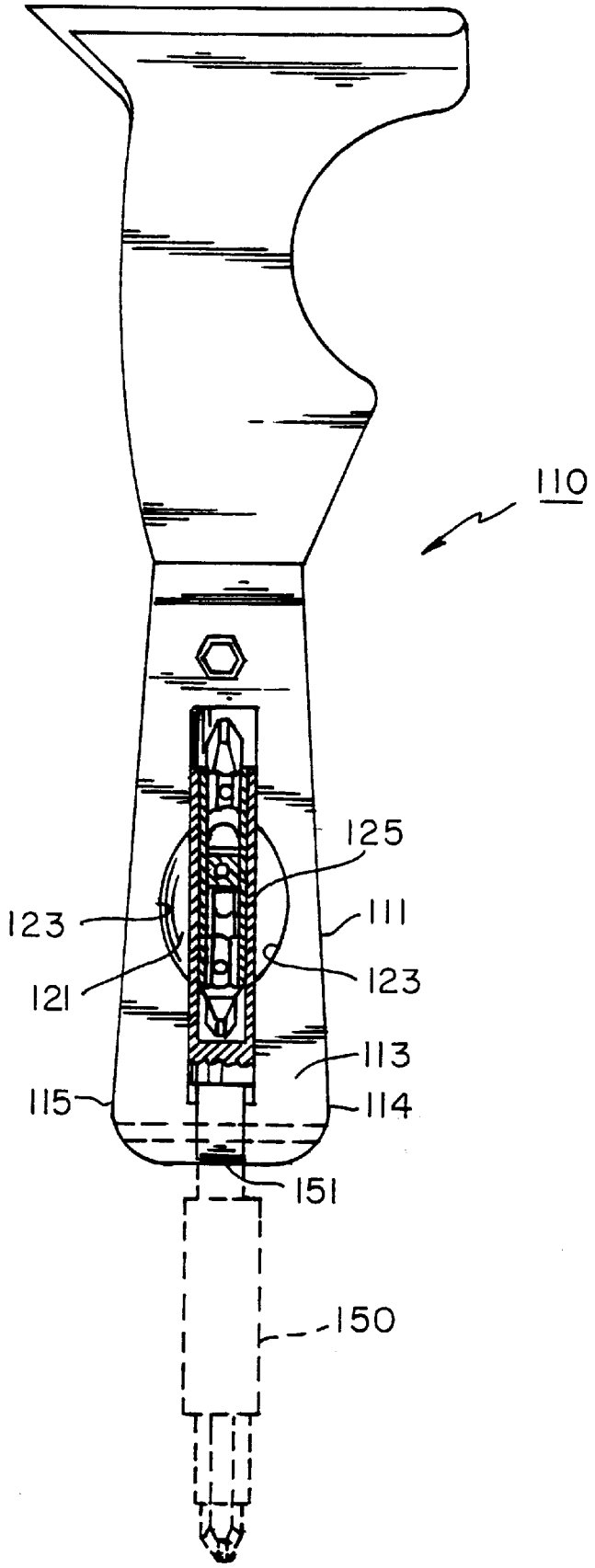
FIG. 5 is a partial developmental elevational view of another embodiment of the hand tool.

Referring now to FIG. 5, there is shown an alternate embodiment, hand tool 110. Hand tool 110 is similar in construction to the afore-described embodiment hand tool 10, but differs in that the tool bit drive assembly 125 is pivotally mounted to be housed within handle 111 central recess 121 which is formed in the side 113 and not in the ends 114 and 115 of the handle. Recess 121 is formed with two adjacent finger grips receses 123 disposed on opposite sides of tool bit drive assembly 125. In this manner of construction the user inserts his/her fingers in recesses 123 and grips assembly 125 and pivots to the extended proximate position 150, which position in this embodiment is centrally or axially disposed at 151 to the handle 111. This axial disposition provides ease of the screwdriver functions. In the hand tool embodiment 110 the extended tool bit drive assembly is axially or centrally disposed.

In the aforesaid manner of construction, the user selects and assembles the desired tool bit drive and trowel element and then pivots the tool bit drive assembly to the most proximate position (FIGS. 1 and 2) and using the most proximately disposed tool bit drive to screw one or more screws into a wallboard. The user then pivot returns the tool bit drive assembly to the recess or fuly retracted position (FIGS. 3 and 4), and then trowels the wall finishing composition over the heads of the recessed screws and at the wallboard joints to provide a smooth even wall surface finish. The user repeats these alternate functions with the single hand tool 10 (or 110) until the job is complete.

The upper or grip portion of the handle is importantly free of protruberances or difficult to grip elements on the sides with the tool bit drive or screwdriver assembly recessed within the handle and also extended away from the handle. This importantly permits ease of use if the trowel and operably extendes the screwdriver.

It is of course understood that various changes and modifications may be made within the spirit and scope of the invention as set out in the adjoined claims.

What is claimed is:

1. A hand tool comprising, handle means, trowel means for spreading a spreadable construction material, and means for attaching said trowel means to said handle means, tool bit drive means for driving a construction attachment element, and means for pivotally attaching said tool bit drive means to said handle means to pivot said tool bit drive means from an inoperable position within the handle means to an operable position disposed away from the handle means, said tool bit drive means comprising an elongated housing comprising oppositely disposed ends, and means for connecting one housing end to said means for pivotally attaching said tool bit drive means, and wherein the other housing end being formed with a cavity, said tool bit drive means further comprising a sleeve slidably disposed in said housing cavity, and a plurality of interchangeable tool bits slidably non-rotatably received in said sleeve, with one tool bit operably disposed in said operable position, whereby the user selectively alternatively grips the handle means and uses either the tool as a trowel or a selected tool bit driver.

2. The hand tool of claim 1, wherein the sleeve is of unitary one-piece construction.

3. The hand tool of claim 1, further comprising means for detachably attaching one of a plurality of trowel means to the handle means.

4. The hand tool of claim 1, wherein the tool bit drive means is centrally disposed with respect to the handle means in the inoperable and operable positions.

5. The hand tool of claim 1, said handle means comprising a handle having oppositely disposed elongated faces and oppositely disposed sides, said means for pivotally attaching said tool bit drive means comprising a pivot axis, said pivot axis being disposed between said handle faces and transversely disposed to said handle sides.

6. The hand tool of claim 5, said tool bit drive means being centrally disposed with respect to said handle sides in the inoperable and operable positions.

7. The hand tool of claim 6, said trowel means comprising a blade, said elongated faces and said blade being in parallel disposition.

8. A hand tool comprising, handle means, bladed tool means being formed with a distally disposed blade edge, and means for attaching said bladed tool means to said handle means, tool bit drive means for driving a construction attachment element, and means for pivotally attaching said tool bit drive means to said handle means which allows said tool bit drive means to pivot from an inoperable position within the handle means to an operable position disposed away from the handle means, said tool bit drive means comprising an elongated housing comprising oppositely disposed ends, and means for connecting one housing end to said means for pivotally attaching said tool bit drive means, and wherein the other housing end being formed with a cavity, said tool bit drive means further comprising a sleeve slidably disposed in said housing cavity, and a plurality of interchangeable tool bits slidably non-rotatably received in said sleeve, with one tool bit operably disposed in said operable position, whereby the user selectively grips the handle means and uses either the bladed tool means or the tool bit drive means.

9. The hand tool of claim 8, said bladed tool means comprising a trowel.

10. The hand tool of claim 8, said blade edge being transversely disposed.

11. A hand tool comprising, handle means, trowel means for spreading a spreadable construction material, and means for attaching said trowel means to said handle means, tool bit drive means for driving a construction attachment element, and means for pivotally attaching said tool bit drive means to said handle means which allows to pivot said tool bit drive means from an inoperable position within the handle means to an operable position disposed away from the handle means, said tool bit drive means comprising an elongated housing comprising oppositely disposed ends, and means for connecting one housing end to said means for pivotally attaching said tool bit drive means, and wherein the other housing end being formed with a cavity, and a plurality of interchangeable tool bits slidably non-rotatably received in said cavity with one selected tool bit being operably disposed in said operable position, whereby the user selectively grips the handle means and uses either the tool as a trowel or tool bit driver.

12. A hand tool comprising, handle means, bladed tool means having a proximate end and a distal end and being formed with a transversely distally disposed working blade edge, and means for attaching said bladed tool means proximate end to said handle means, tool bit drive means for driving a construction attachment element, and means for pivotally attaching said tool bit drive means to said handle means which allows said tool bit drive means to pivot from an inoperable position within the handle means to an operable position disposed away from the handle means, said tool bit drive means comprising an elongated housing comprising oppositely disposed ends, and means for pivotally connecting one housing end to said means for pivotally attaching said tool bit drive means, and wherein the other housing end being formed with a cavity, and further comprising a plurality of interchangeable tool bits slidably non-rotatably received in said cavity, with one tool bit being operably disposed in said operable position, whereby the user selectively grips the handle means and uses the working blade edge or the operably disposed tool bit.

13. The hand tool of claim 12, said bladed tool means comprising a trowel.

14. The hand tool of claim 12, said housing comprising an elongated sleeve having a central axis, said handle means comprising an elongated handle having a central axis, said central axes being in parallel disposition in said operable position.

15. The hand tool of claim 12, said blade edge being transversely disposed.

* * * * *

UNITED STATES PATENT AND TRADEMARK OFFICE

CERTIFICATE OF CORRECTION

PATENT NO. : 6,131,222

DATED : October 17, 2000

INVENTOR(S) : Wayne Anderson and Paolo Cassutti

It is certified that error appears in the above-identified patent and that said Letters Patent is hereby corrected as shown below:

In claim 12, at line 3, delete "transversely".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*